US006036588A

United States Patent [19]

Loth

[11] Patent Number: 6,036,588

[45] Date of Patent: Mar. 14, 2000

[54] KNIFE RING [CHIP] CUTTER

[75] Inventor: Robert Loth, Lage-Mussen, Germany

[73] Assignee: B. Maier Zerkleinerungstechnik GmbH, Bielefeld, Germany

[21] Appl. No.: 09/071,572

[22] Filed: May 1, 1998

[30] Foreign Application Priority Data

May 2, 1997 [DE] Germany ..... 197 18 681

[51] Int. Cl.[7] ..... B24B 7/00

[52] U.S. Cl. ..... 451/293; 451/45; 451/57; 451/65; 451/82; 451/248; 451/247; 451/293; 451/401

[58] Field of Search ..... 451/45, 57, 65, 451/82, 248, 247, 293, 401

[56] References Cited

U.S. PATENT DOCUMENTS 5,377,454 1/1995 Pedersen et al. ..... 451/5

FOREIGN PATENT DOCUMENTS 43 16514 11/1994 Germany ..... B02C 18/18

4316514 C2 2/1996 Germany .

19641810 11/1997 Germany ..... B02C 18/18

19641810 C1 11/1997 Germany .

*Primary Examiner*—David A. Scherbel

*Assistant Examiner*—Shantese McDonald

*Attorney, Agent, or Firm*—Ohlandt, Greeley, Ruggerio & Perle

[57] ABSTRACT

The invention concerns a device for sharpening of knives, which are mounted in the knife ring of a chip cutter and whose cutting edges run essentially parallel to the knife ring axis. Several grinding tools can be run intermittently and simultaneously in the direction of the knife ring axis in order to sharpen individual knives The knife ring stands still during the sharpening and is rotated around its own axis during the pauses between sharpening corresponding to the distribution of the knives over the periphery of the knife ring. Any grinding tool sharpens any knife in such a way that the desired total (amount of) removed grinding material is achieved with the last grinding tool in the peripheral direction of the knife ring.

5 Claims, 4 Drawing Sheets

KNIFE RING [CHIP] CUTTER

FIELD OF INVENTION

The invention concerns a process as well as a device for the sharpening of knives of a knife ring cutter.

BACKGROUND OF INVENTION

Knife ring cutters serve for the production of chips, which will be used particularly for the production of particle board. Such a knife ring cutter has a knife ring. This in turn comprises a number of knife units. Each knife unit has a carrying block, which carries a knife and which has an abrasion surface. The abrasion surface is turned toward a rotor, which is mounted in a rotatable manner inside the knife ring. The knife ring is in turn surrounded by a housing.

Knives are subjected to a great extent to wear. They have a service life, which is calculated at only several hours. They must therefore be resharpened frequently. Earlier, the knives had to be dismantled for resharpening. In the meantime, however, devices have become known by means of which it is also possible to leave the knives in the knife ring during sharpening. For example, refer to DE 4,316,514 B1. Here, the knife ring can be taken off the cutter and inserted in a stand. It is mounted in a rotatable manner therein. In this position it encloses a sharpening unit for purposes of sharpening. The sharpening unit undertakes a translational movement parallel to the axis of the knife ring for purposes of sharpening, while the knife ring undertakes a slow rotational movement around its own axis. The grinding wheel is thus applied with its front side successively to the knives. Due to the translational movement, it migrates along the knife ring axis from a first front side to its other front side in the course of a time frame of approximately 1 to 2 hours.

Another process with a corresponding device for sharpening knives in the knife ring has also become known from DE 19 641 810 A1. This process basically operates differently. Here also, a sharpening device is provided, which can be placed precisely inside the knife ring as in the first-named device, and this executes a translational movement parallel to the knife ring axis. However, the knife ring is locked resistant to rotation during the sharpening process, and thus stands still until a knife or a group of knives is sharpened. Then the knife ring executes a limited rotational movement, corresponding to the distribution of the knives over the periphery of the knife ring.

The provision of a multiple number of knives, which are mechanically coupled together to form a knife group, is advantageous insofar as several knives can be equally sharpened with one translational motion. For example, if four grinding tools are present, then four knives can be sharpened simultaneously. After these four knives have been sharpened, the knife ring is rotated by a radian measure, so that the grinding tools are found in the positions of the next four knives.

Recently, the requirements for chip quality have increased. Chip quality depends on a number of parameters, including the preliminary state of the knife, the wood quality, but also the quality of the ground section. It has thus been shown that chip quality no longer satisfies the requirements. The confusing multiplicity of parameters always provides further impetus for speculations in order to discover disruptive influences. This has previously not proven successful to the extent necessary.

SUMMARY OF INVENTION

The invention takes on the task of indicating a process as well as a device for the sharpening of knives, with sharpening of the knives within the knife ring, in order to increase chip quality.

The inventor has recognized that the quality of the sharpening of knives has a decisive influence on the chip quality, and that in previously known processes or devices, the sharpening quality has considerable deviations from one knife to another, which leads to corresponding deviations in chip quality. Thus a specific knife produces a specific chip quality, and another knife produces another chip quality. The quality of the sharpening, however, again depends on the grinding tool. The inventor has also recognized the fact that when one and the same knife is sharpened by several grinding tools, these superimpose and to a certain extent mingle favorable or unfavorable properties of the individual grinding tools, so that the quality of the sharpening of all knives is the same. Accordingly, the quality of the chips, which one specific knife produces is the same as the chip quality of the other knives. In contrast to the state of the art, a specific knife will thus not be resharpened by an individual grinding tool, but the sharpening of the individual knife is the result of the sharpening of all grinding tools of a group of grinding tools.

DESCRIPTION OF PREFERRED EMBODIMENT

Figure 1:
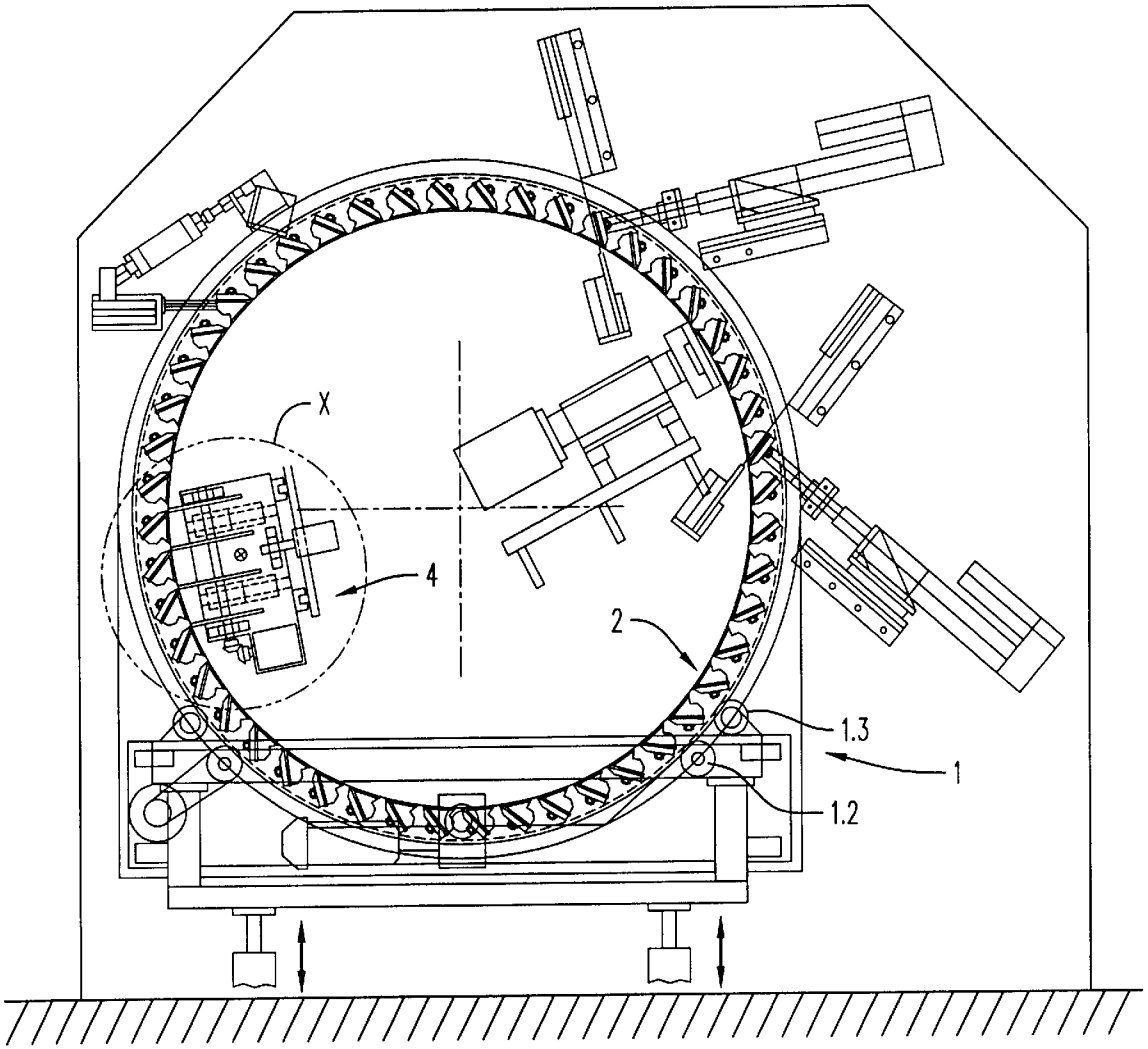
FIG. 1 is an elevation view of a sharpening device according to the present invention.

The invention is explained in more detail on the basis of the drawing. Taken individually, the following is shown:

FIG. 1 shows a device for conditioning [sharpening] the knives of a chip cutter. The cutter is not shown here.

Conditioning device 1 can be transported on rollers 1.2 relative to the cutter such that a knife box can be taken up on the cutter and can be transported away by this, to the working position of conditioning device 1. In the example of embodiment represented, a knife box 2 is utilized in conditioning device 1. It rests on rollers 1.3, so that it can be cycled around its own axis in conditioning device 1.

Figure 2:
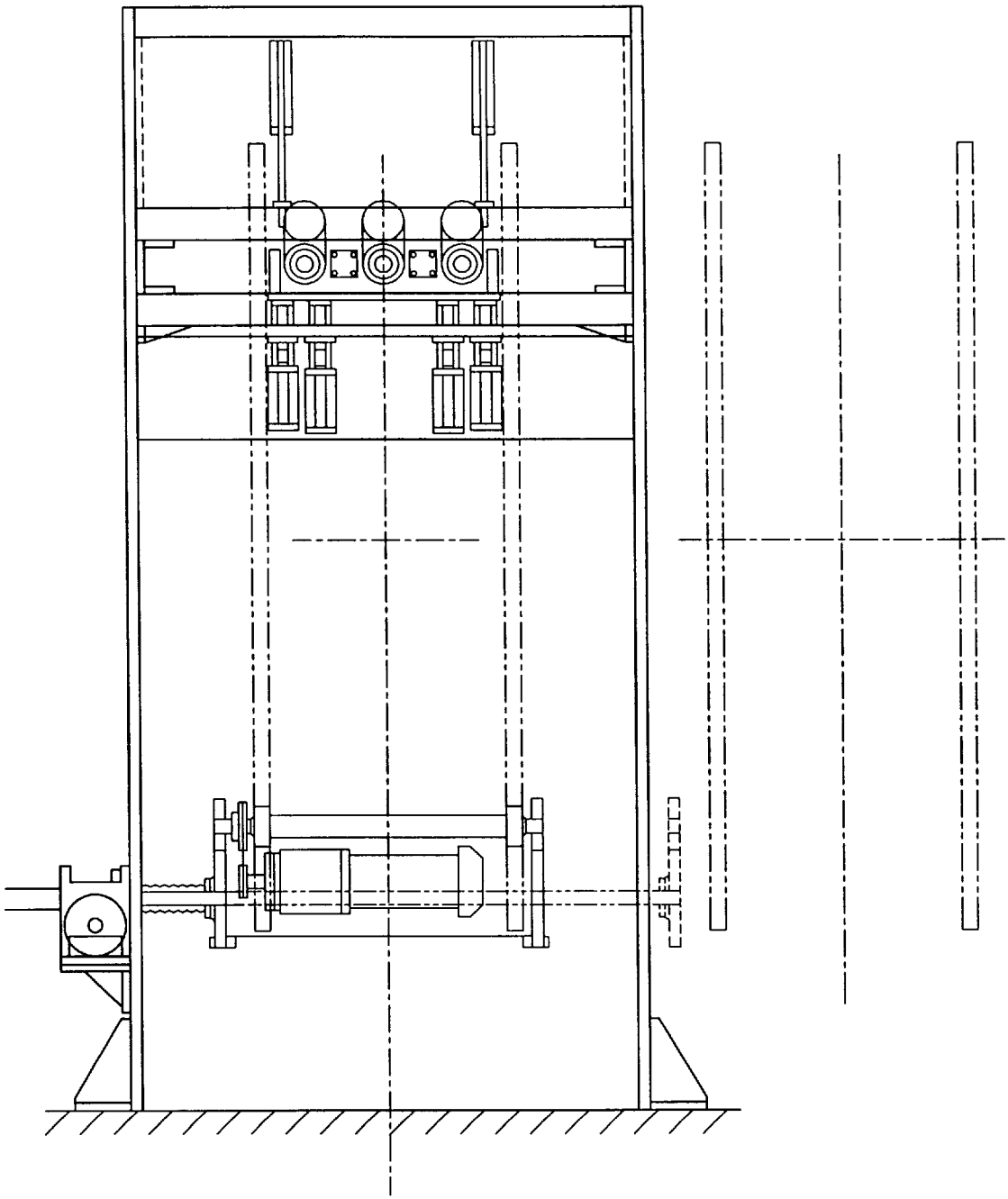
FIG. 2 is a side view of the sharpening device of FIG. 1.

FIG. 2 shows conditioning device 1 in a side view.

Figure 3:
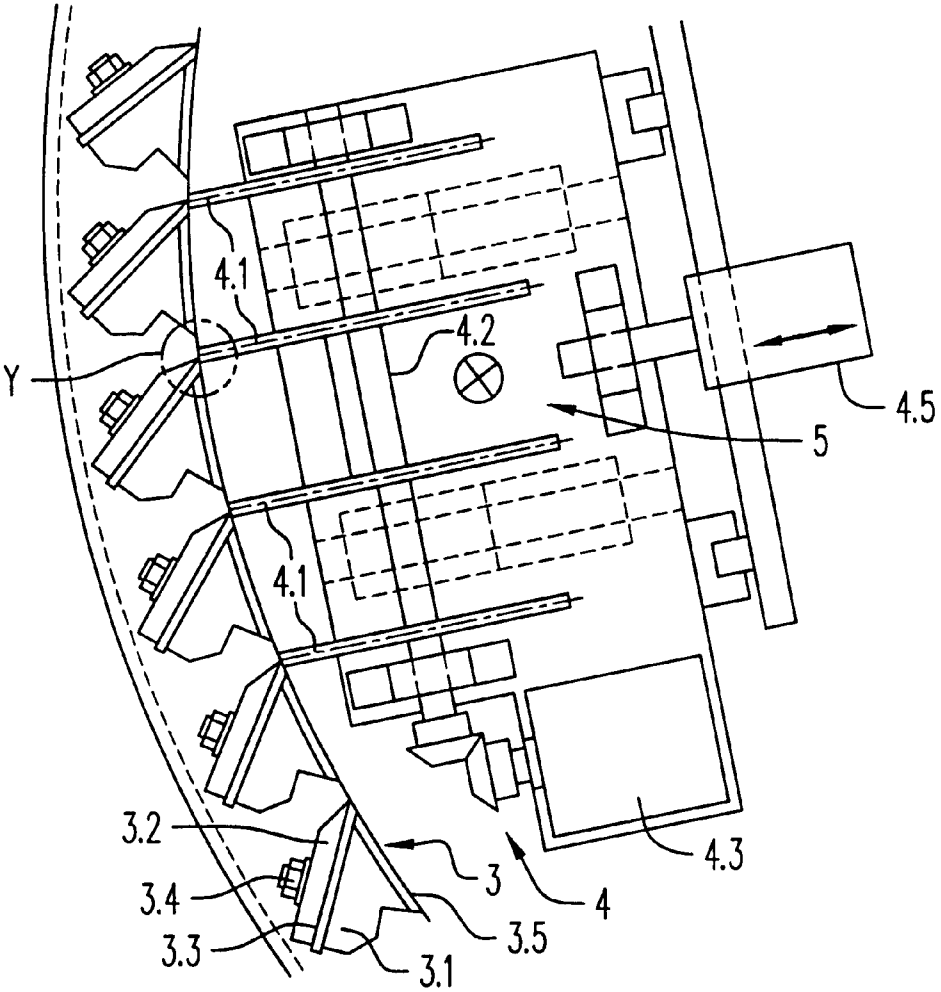
FIG. 3 is a magnified view of the detail of the grinding tools of the sharpening device of FIG. 1.

Knife box 2 has a number of knife packages 3, which can best be recognized from FIG. 3. A carrying block 3.1, a clamping plate 3.2, a knife 3.3 found between the latter two, a tightening screw 3.4, as well as an abrasion plate 3.5 are provided there.

The decisive element of the entire device is the tool, in the present case, a sharpening device 4. This can be recognized from FIG. 1, but is given more precisely in FIG. 3. Sharpening device 4 comprises a multiple number of grinding wheels 4.1. In the present case, this involves four grinding wheels. These four grinding wheels sit on a common shaft 4.2. The latter can be driven by means of a motor 4.3 and a beveled gear drive 4.4. Further, a spindle drive with stepping motor 4.5 can be seen.

The entire device operates as follows:

As soon as knives 3.3 no longer have the necessary sharpness, the entire knife box is taken out of the cutter by means of conditioning device 1. Then sharpening device 4 is introduced into the inside space enveloped by knife box 2. Sharpening device 4 is positioned such that each grinding wheel 4.1 lies opposite a knife 3.3 to be sharpened. Drive motor 4.3 sets grinding wheel 4.1 in rotation by means of beveled gear drive 4.4 and drive shaft 4.2, and stepping motor 4.5 drives the entire unit in the direction of the double arrow-seen in FIG. 3-to the left, so that the peripheral surfaces of grinding wheels 4.1 come to lie at the surfaces of knives 3.3 to be sharpened.

Another drive is provided, of which here only shaft 5 is symbolically shown. This drive produces a movement of sharpening device 4 parallel to the axis of knife unit 2 and also parallel to the sharpening of knives 3.3. Thus the grinding of each knife can be completed with a single back-or-forth passage of sharpening device 4. However, it is also possible to conduct two or more movements in one direction and then the other.

Sharpening device 4 may have a different number of grinding wheels 4.1 than the four grinding wheels shown here. Thus, only a single grinding wheel need be provided. However, more than four grinding wheels may also be provided.

It is also possible to arrange grinding wheels 4.1 in such a way that they run in radial planes, which pass through the middle point of knife box 2. This applies both to the case of a single grinding wheel per sharpening device 4 as well as for the case when a sharpening device 4 has a multiple number of grinding wheels.

It is also conceivable to change the inclination of the individual grinding wheels 4.1, so that the angle, which is applied to knives 3.3 for sharpening, is variable.

The following is a decisive factor according to the invention:

Each individual grinding wheel 4.1 sharpens each individual knife 3.3 in such a way that the desired total [amount of] removed grinding material is obtained with the last sharpening tool in the direction of rotation of the knife ring. This can be produced, for example, by pressing the grinding wheels to differing degrees against the knife to be sharpened. As a rule, the instructions according to the invention are executed by positioning the individual grinding wheels with reference to the knives to be sharpened.

Figure 4:
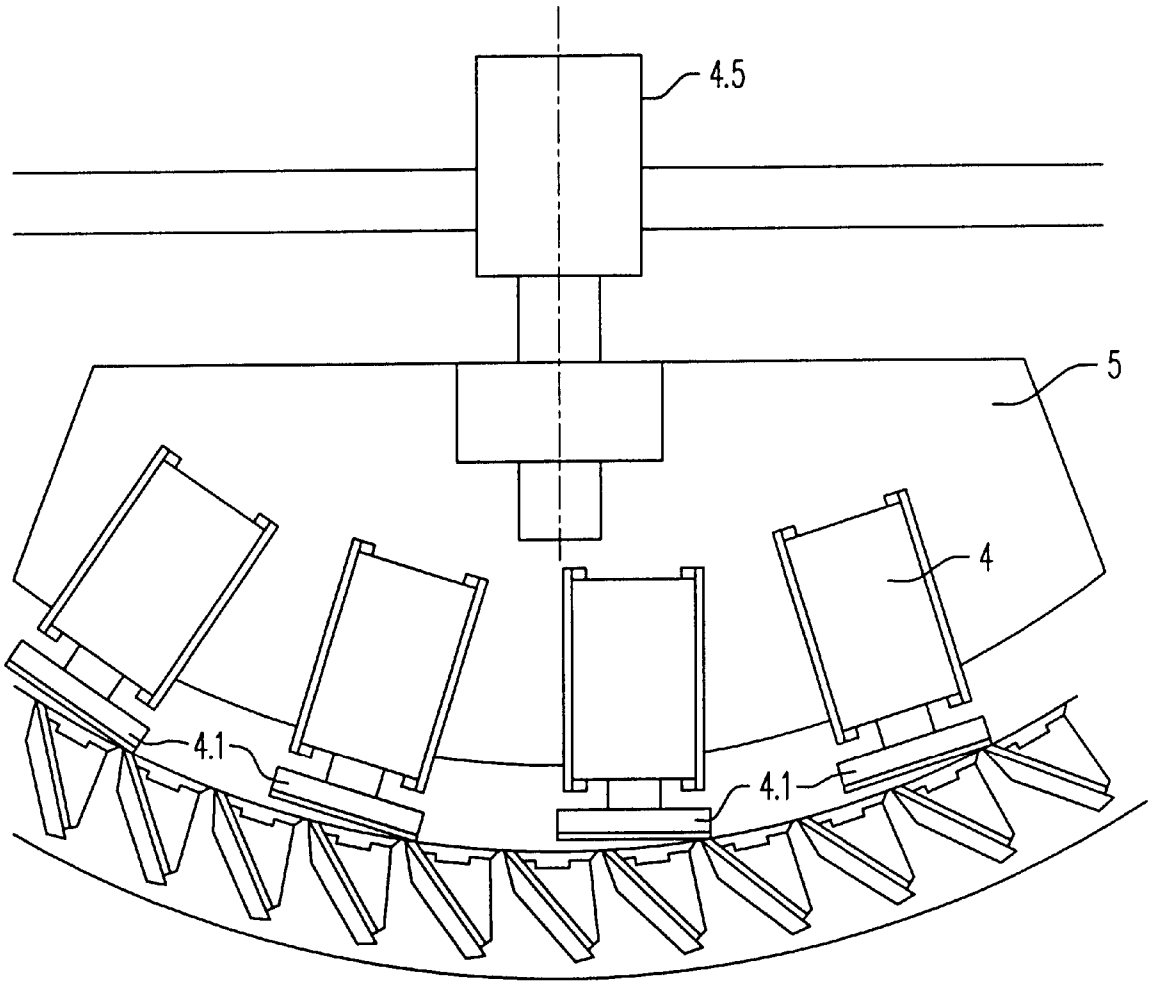
FIG. 4 is a magnified view of the detail of the grinding tools with a flaring cup type tool for the sharpening device of FIG. 1.

FIG. 4 shows a form of embodiment of the invention, in which processing is conducted with flaring cup wheels as grinding tools. Each of the grinding tools 4.1 shown there has the configuration of a flared cup, which is open opposite the knife edge to be sharpened; the bottom of the cup is thus turned away from the knife edge. Sharpening is conducted with the flared edge. The rotating axis of each flaring cup wheel 4.1 runs essentially radially to the knife box. A free angle is presented to the knife for sharpening by deviation from the radial line, as shown in FIG. 4.

Basically, any grinding tool can partially sharpen any knife. However, it is also possible, that a single grinding tool can completely finish sharpening one and the same knife.

What is claimed is:

1. A process for sharpening a plurality of knives that are mounted in a knife ring of a chip cutter, said knives having cutting edges that run essentially parallel to an axis of said knife ring, said process comprising:

conducting an intermittent sequence of sharpening operations with a plurality of grinding tools that run simultaneously in the direction of said axis of said knife ring axis in order to sharpen individual ones of said plurality of knives;

maintaining said knife ring still during said sharpening operations; and rotating said knife ring during pauses occurring between said sharpening operations by an amount corresponding to the distribution of said plurality of knives over the periphery of said knife ring, whereby any one of said grinding tools sharpens all one of said plurality of knives in such a way that the desired amount of removed grinding material of said sharpened knife is achieved with the last one of said plurality of grinding tools in the peripheral direction of said knife ring.

2. The method of claim 1, wherein each one of said grinding tools partially sharpens each one of said plurality of knives.

3. A device for sharpening a plurality of knives of a knife ring cutter, said device comprising:

means for rotating said knife ring on its axis in a stepwise manner by arc segments corresponding to the distance between adjacent ones of said plurality of knives;

grinding means including a plurality of grinding tools arranged to sharpen said plurality of knives, said grinding tools being movable in a travel motion in the direction of said axis of said knife ring and being joined rigidly together relative to said travel motion; and said grinding means having a number of parameters that are dimensioned such that the desired total amount of removed cutting material of all of said plurality of knives is reached with the last one of said plurality of grinding tools in the peripheral direction of said knife ring.

4. Device according to claim 3, further characterized in that at least one of said grinding tools is a flaring cup wheel.

5. The device of claim 3, wherein at least one of said number of parameters is dimensioned such that any one of said knives is only partially sharpened by any one of said grinding tools.

* * * * *